US007064633B2

(12) United States Patent
Wu et al.

(10) Patent No.: US 7,064,633 B2
(45) Date of Patent: Jun. 20, 2006

(54) WAVEGUIDE TO LAMINATED WAVEGUIDE TRANSITION AND METHODOLOGY

(75) Inventors: Ke-Li Wu, Shatin (HK); Yong Huang, Shatin (HK)

(73) Assignee: The Chinese University of Hong Kong, Shatin (CN)

( * ) Notice: Subject to any disclaimer, the term of this patent is extended or adjusted under 35 U.S.C. 154(b) by 0 days.

(21) Appl. No.: 10/620,300

(22) Filed: Jul. 14, 2003

(65) Prior Publication Data

US 2004/0145426 A1 Jul. 29, 2004

Related U.S. Application Data

(60) Provisional application No. 60/395,952, filed on Jul. 13, 2002.

(51) Int. Cl.
*H01P 5/107* (2006.01)

(52) U.S. Cl. ..... 333/230; 333/26

(58) Field of Classification Search ..... 333/254, 333/33, 26, 230

See application file for complete search history.

(56) References Cited

U.S. PATENT DOCUMENTS 5,982,256 A * 11/1999 Uchimura et al. ..... 333/239

FOREIGN PATENT DOCUMENTS

JP 1340701 * 12/1999

* cited by examiner

*Primary Examiner*—Benny Lee
(74) *Attorney, Agent, or Firm*—Knobbe Martens Olson & Bear, LLP

(57) ABSTRACT

One embodiment of the present invention includes a structure that defines at least a transition interior, the structure including electrically-conductive materials, the structure defining first and second openings to the transition interior, the first opening configured to be open toward a first interior, of a first waveguide, which is a laminated waveguide, and the second opening configured to be open toward a second interior, of a second waveguide, the second interior being defined by an electrically-conductive structure of the second waveguide, whereby an electromagnetic wave is capable of being propagated via the transition interior, from one of the first and second interiors to the other of the first and second interiors, wherein content of the first interior has a dielectric constant that differs from a dielectric constant of content of the second interior, and the second waveguide is not laminated on the substrate on which the first waveguide is laminated.

37 Claims, 6 Drawing Sheets

WAVEGUIDE TO LAMINATED WAVEGUIDE TRANSITION AND METHODOLOGY

RELATED APPLICATION(S)

The present patent application is related to and claims the benefit of priority from commonly-owned U.S. Provisional Patent Application No. 60/395,952, filed on Jul. 13, 2002, entitled "Waveguide to Laminated Waveguide Transition and Methodology", which is hereby incorporated by reference in its entirety for all purposes.

TECHNICAL FIELD

The present invention relates to an apparatus and/or methodology involving transitioning an electromagnetic wave between two waveguides. Embodiments of the present invention are especially suitable for use where there is a scale mismatch between the two waveguides, for example, when the two waveguides include materials in their interior that have different (finite) dielectric constants.

BACKGROUND OF THE INVENTION

Metal waveguides and laminated waveguides are examples of transmission lines that transport electromagnetic energy. A metal waveguide is usually constructed as a metal tube in which an electromagnetic signal wave propagates along the interior of the tube by reflecting back and forth between the walls of the waveguide. A metal waveguide can be filled either with air or dielectrics and its cross-section is generally circular or rectangular.

Metal waveguides have a critical wavelength for passage of signals within. The wavelength is determined by the geometry and the size of the waveguide. Only those signals whose wavelength is shorter than the critical wavelength can propagate in the waveguide. At high microwave frequency, particularly the millimeter-wave frequency, the metal waveguide has proven to be a transmission line with minimum signal loss.

A laminated waveguide is a derivative of the metal waveguide. Instead of using a solid metal tube, a typical laminated waveguide is composed of a dielectric substrate, a pair of main conductive layers deposited on the upper surface and the lower surface of the dielectric substrate, a plurality of through conductors such as filled via-holes extending in a thickness direction in the dielectric substrate so that the through conductors electrically connect the pair of the main conductive layers and a number of sub-conductor strip layers, which are embedded and electrically connected to the via-holes within the dielectric substrate. A laminated waveguide constructed in the said way has reasonably good transmission characteristics of a high-frequency signal and has advantages in cost of production and in ability to be integrated with circuits.

SUMMARY OF THE INVENTION

It is advantageous in a system to have coexisting modules that use different types of waveguides, for example, waveguides that differ from each other in physical scale. For example, the different types of waveguides may include materials in their interior that have dielectric constants that differ from one another. For example, one type of waveguide may be a laminated waveguide, and the other type may be a metal waveguide. What is needed are methods and apparatuses that allow transition between different types of waveguides.

According to some embodiments of the present invention, there is a waveguide to laminated waveguide transition integrated with a multi-layer substrate package.

According to some embodiments of the present invention, there is a waveguide to laminated waveguide transition in an integrated functional module that can be easily fabricated.

According to some embodiments of the present invention, there is a waveguide to laminated waveguide transition that can be inexpensively fabricated in high volume production.

According to some embodiments of the present invention, there is a waveguide to laminated waveguide transition that is effective at millimeter-wave and high microwave frequencies.

According to some embodiments of the present invention, there is an apparatus through at least a portion of which electromagnetic waves are to be propagated. The apparatus comprises: a structure, hereinafter referred to as the boundary structure, that defines at least an interior, hereinafter referred to as the transition interior, the boundary structure including electrically-conductive materials, the boundary structure further defining a first opening and a second opening to the transition interior, the first opening configured to be open toward an interior, hereinafter referred to as the first interior, of a laminated waveguide, hereinafter referred to as the first waveguide, and the second opening configured to be open toward an interior, hereinafter referred to as the second interior, of a second waveguide, the second interior being defined by an electrically-conductive structure of the second waveguide, whereby an electromagnetic wave is capable of being propagated, for use, via the transition interior, from one of the first interior and the second interior to the other of the first interior and the second interior, wherein electrically conductive material of the first interior has a dielectric constant that differs from a dielectric constant of electrically conductive material of the second interior, and the second waveguide is not laminated on the substrate on which the first waveguide is laminated.

According to some embodiments of the present invention, there is a method for transitioning electromagnetic waves from a first waveguide to a second waveguide, the first waveguide having a first interior defined by an electrically-conductive first structure, the second waveguide having a second interior defined by an electrically-conductive second structure, the content of the first and second interiors having mutually-different dielectric constants, the method comprising: accepting an electromagnetic wave directly from the first interior into an interior, hereinafter referred to as transition interior, of a transition, the transition interior being defined by an electrically-conductive structure of the transition, the transition interior being open to the first and second interiors; conveying the electromagnetic wave directly from the transition interior into the second interior.

According to some embodiments of the present invention, there is a method for producing a waveguide-to-waveguide transition. The method comprises fabricating an electrically-conductive structure, hereinafter referred to as a transition boundary structure, the transition boundary structure defines an interior, hereinafter referred to as a transition interior, including a first opening and a second opening to the transition interior, wherein, at least after the transition is deployed for use, the first opening is to open toward a first interior of a first waveguide and the second opening is to open toward a second interior of a second waveguide, the first and second interiors comprising mutually-different materials having mutually-different dielectric constants.

DETAILED DESCRIPTION OF EMBODIMENTS OF THE INVENTION

Figure 1:
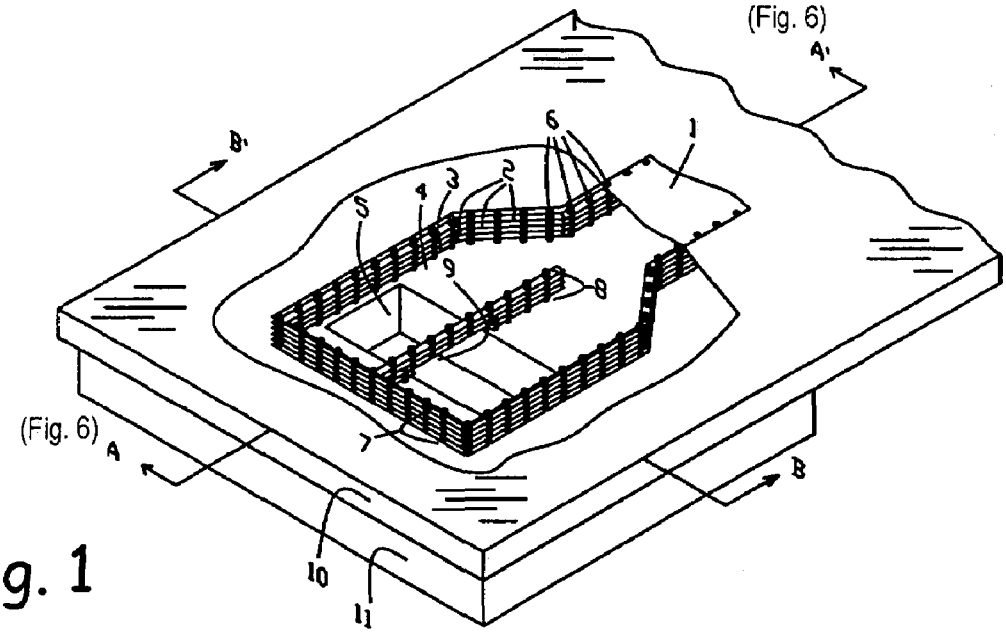
FIG. 1 is a schematic 3D cut-away perspective view showing a first embodiment of the integrated transition with a rectangular air filled waveguide flange of the present invention.

The description above and below and the drawings of the present document focus on currently preferred embodiments of the present invention and also describe some exemplary optional features and/or alternative embodiments. The description and drawings are for the purpose of illustration and not limitation. In each of the drawings like reference numerals refer to like features.

In many commercial and military systems operating in millimeter wave frequency range, such as vehicular and military radars and various types of communication systems, in order to minimize attenuation and maintain high efficiency and sensitivity, a waveguide transmission line is used as the major means for distributing and collecting the high frequency signal among various modules such as an antenna array and front end modules.

Conventional solutions using a solid metal waveguide system entail the use of expensive mechanical machining. With modem advances in multi-layer manufacturing technology and low loss materials, it is advantageous, especially in the newly developed millimeter-wave Local Multipoint Distribution System (LMDS) and anti-collision radar systems for automobiles, to use integrated laminated waveguides instead of metal waveguides to minimize size and cost. Therefore, it will be advantageous in a system to have coexisting integrated modules that use both a laminated waveguide as the main embedded transmission line and also modules that are interfaced with a metal waveguide. Thus, a key device in connecting the two different types of modules in such systems is a metal waveguide to laminated waveguide transition that provides low signal loss in a broad frequency band.

Due to the high dielectric constant in the substrate (e.g., about 7 to 20), the transversal dimension of a laminated waveguide, which determines the signal frequency down the transmission line, can be less than half of the transversal dimension of the metal waveguide. This large dimension mismatch causes a great difficulty to design a low loss transition between the two types of waveguides, particularly a broadband transition. There are, at least, three attractive features to a broad frequency bandwidth transition: (1) being able to handle broadband signal including transmitted and received bands; (2) being able to accommodate large mechanical tolerance to improve the yield in high volume production and (3) providing low insertion loss.

According to some embodiments of the present invention, there is a waveguide to integrated laminated waveguide transition that is a directly fabricated and hermetically sealed packaging structure, which may also connect the conventional waveguide equipment, through the integrated laminated waveguide, to certain functional apparatuses, such as antenna arrays, operating at millimeter-wave or microwave frequencies. Several types of waveguides are well-known in the art. It is contemplated that in some embodiments of the invention the transition is between two waveguides, neither of which are of the laminated or metal type.

A circuit system integrated with a laminated waveguide can be produced by a laminating technology, such as Low Temperature Co-fired Ceramics (LTCC) technology, and has excellent productivity.

According to some embodiments of the present invention, there is a broadband and compact integrated transition between a laminated waveguide and a metal waveguide. The novel transition adopts the concept of a multi-parallel-coupled 2-pole resonator filter to create two resonant poles in the pass-band. A Ka band embodiment (e.g., at 29 GHz) shows a very low loss over a broad (e.g., better than 8.5%) frequency bandwidth.

According to some embodiments of the present invention, there is a waveguide to laminated waveguide transition that includes a number of sub-circuits. Laminated waveguides comprise single or multiple dielectric substrate layers, and a pair of main conductive layers laminated on the upper surface and the lower surface of the dielectric substrate layers. A plurality of via-holes extending in a thickness direction in the dielectric substrate layers so that they electrically connect the pair of main conductive layers to form conductive walls. A number of sub-conductive layers, which are embedded in the dielectric substrate parallel to the main conductive layers and electrically connected to the via-holes to enhance the conductive walls, are optional to provide further reduction of the leakage of electromagnetic signals. The conductive layer on the lower surface that faces the metal waveguide is selectively patterned such that conductive material is removed over the metal waveguide aperture.

According to some embodiments of the present invention, the integrated transition comprises multi-parallel inter-coupled resonator chains formed by said through conductive partition walls. Partial metal strip and correlating through conductors in conductive partition walls are removed to help provide matching to a metal waveguide. Each resonator chain comprises two resonators connected in series. One resonator in a resonator chain (which is called type I resonator hereinafter) is a section of a laminated waveguide, whose lower conductor layer is partially removed, is shorted at one end and connected with the other resonator (which is called type II resonator hereinafter); Both type I and type II resonators are quasi half wavelength resonators that resonate around the working frequency; the resonant frequency is controlled by the location of the shorting wall. The type II resonator consists of a section of laminated waveguide and a junction of the laminated waveguide branch divider connecting with the main laminated waveguide. The junction essentially is a part of a multi-branch divider junction used to combine and distribute electromagnetic energy to each laminated waveguide branch composing a resonator chain. The junction provides an appropriate termination to each of the resonator chains and a slight inter resonator coupling.

The working mechanism of the transition can be explained, for example, by the concept of a multi-parallel inter-coupled 2-pole resonator filter, which creates two resonant poles in the pass-band. An equivalent circuit model is given in FIG. 8 to interpret the concept in conjunction with its 3D structure shown in FIG. 1.

According to some embodiments of the present invention, the waveguide to laminated waveguide transition and associated multi-layer (such as LTCC) module are suitable for use with microwave and millimeter-wave frequencies (approximately 20–100 GHz) with very low insertion loss. The multi-layer module offers routing of DC and microwave/millimeter-wave signals through the layers inside the module thereby minimizing the size of the module. The associated multi-layer module can be a passive integrated front-end module such as filters, diplexers, and antenna arrays, or an active integrated module consisting of monolithic millimeter-wave integrated circuit (MMIC) and laminated waveguide network. As a result, applications which require an interface of a conventional metal waveguide to integrated laminated waveguide modules for high frequency signal transmission can readily make use of the low cost, high performance metal waveguide to laminated waveguide transition provided by some embodiments of the present invention.

The laminated waveguide concerning some embodiments of the present invention comprises a plurality of through conductors such as via-holes disposed at carefully designed intervals, a plurality of sub-conductor layer deposited between dielectric layers of a dielectric substrate and the upper and the lower main conductor layers so as to electrically connect between through conductors within the dielectric substrate formed by the laminated dielectric layer. The metal waveguide concerning some embodiments is either an air filled or dielectric filled waveguide separated from the laminated dielectric layers and will be called metal waveguide hereinafter. The integrated module and the waveguide concerning the invention can be joined, for example, by soldering, conductivity adhesive or the like. In many envisioned applications, the laminated waveguide's interior is filled with material having a dielectric constant that is greater than that of material in the interior or a metal waveguide. For example, a metal waveguide may be filled with air, which has a far lower dielectric constant (one) than dielectric materials in a laminated waveguide. For non-limiting examples, the difference in dielectric constant may be more than three, or more than seven, or of even greater difference.

FIG. 1 is a schematic perspective cut-away view of a first embodiment of the transition of the present invention. The transition is integrated within a multi-layer ceramic substrate module 10, and connected with metal waveguide 11.

The laminated waveguide transition in FIG. 1 consists of a dielectric substrate formed by a plurality of dielectric layers, main conductive layers 1 and 4 deposited on the upper and the lower surface of the dielectric substrates, a plurality of sub-conductor layers 2 and 3, deposited between the laminated dielectric layers composing the dielectric substrate, and a number of through conductors, filled via-holes 6, so as to electrically connect the main conductor layers 1 and 4, and the sub-conductor layers 2 and 3 to form a 3D waveguide resonator structure in dielectric substrate. The interval space between via-holes inside the through conductor wall is predetermined by the working frequency. The number of dielectric layers is determined by the size of the laminated waveguide and thickness of each dielectric layer.

An aperture 5 is deposited on the lower main conductor layer 4. Line B–B' is parallel to and in proximity of the midline of aperture S in the narrow sidewall direction. The conductive wall along line A–A' is called the partition wall hereinafter and denoted as 8 in FIG. 1. The matching aperture 9 is on the partition wall 8. The conductive wall 7 parallel to the line B–B' in FIG. 1 is a shorting wall to the laminated waveguide resonators.

Thus, the features 1, 4, 2, 3, and 6 of FIG. 1 are an example of a structure that defines an interior of the transition of FIG. 1. Moving in the interior of the transition, in a direction opposite the conductive shorting wall 7, leads to an interior of a laminated waveguide. The transition of FIG. 1 includes an opening, e.g., defined by the sidewalls and the layers 1 and 4, that opens into the interior of the laminated waveguide. The aperture 5 opens toward an interior of the metal waveguide 11.

Figure 2:
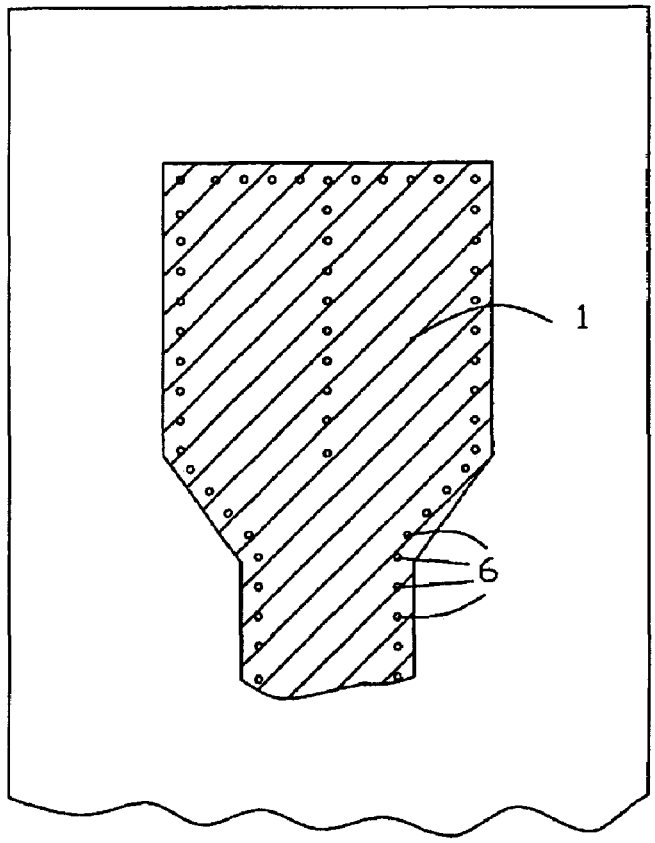
FIG. 2 is a schematic plan view showing the upper main conductor layer in FIG. 1.

FIG. 2 schematically illustrates the upper main conductor layer 1 in FIG. 1. The upper main conductor layer 1 is fully moralized in the transition circuit region and is connected with the next sub-conductor layer by an array of via-holes 6. In FIG. 1 the upper layer 1 is optionally the upper exposed surface of the dielectric substrate.

Figure 3:
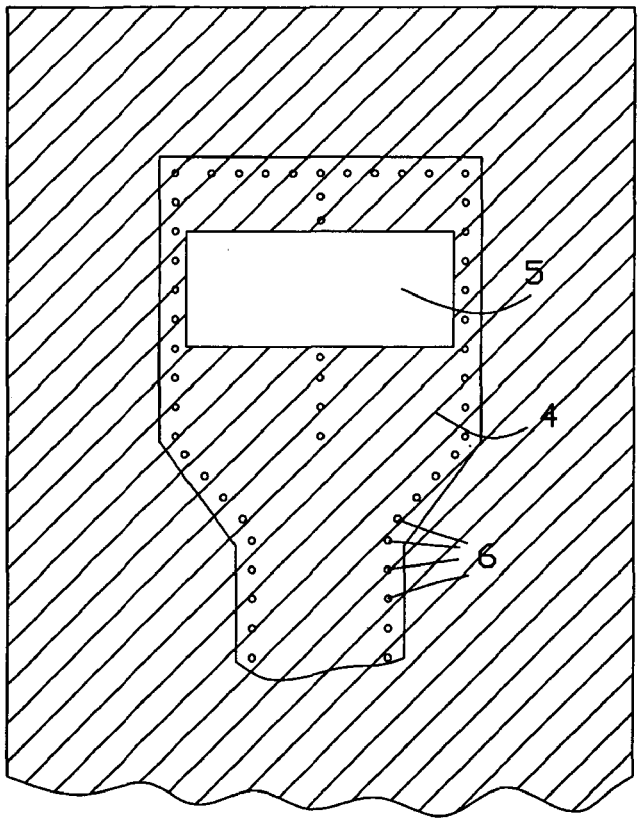
FIG. 3 is a schematic plan view showing the lower main conductor layer in FIG. 1, on which aperture is laid.

FIG. 3 schematically shows a plan view of layer 4. Aperture 5 is laid on main conductor layer 4 and not covered by the conductor. The electromagnetic energy is transmitted via aperture 5 between metal waveguide 11 and the laminated waveguide inside the multi-layer module 10, as shown in FIG. 1. The flange of the metal waveguide 11 beneath the dielectric substrate showing in FIG. 1 is soldered on the main conductor layer 4 with the inside aperture of metal waveguide 11 aligned with the edge of aperture 5.

The sub-conductor layers of the transition of the embodiment of FIG. 1 have the same circuit pattern and are electrically connected by an array of via-holes 6 to form the outside wall, partition wall and shorting wall. To construct the matching aperture 9 on the partition wall 8, partial metal strips on sub-conductor layer 3 and the correlating via-holes are removed.

Figure 4:
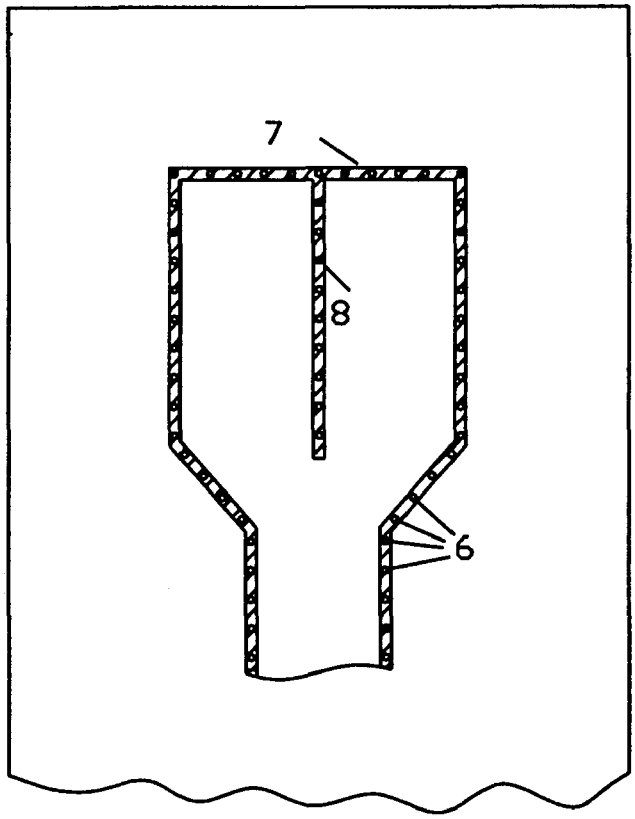
FIG. 4 is a schematic plan view showing circuit pattern of sub-conductor layers in FIG. 1.
Figure 5:
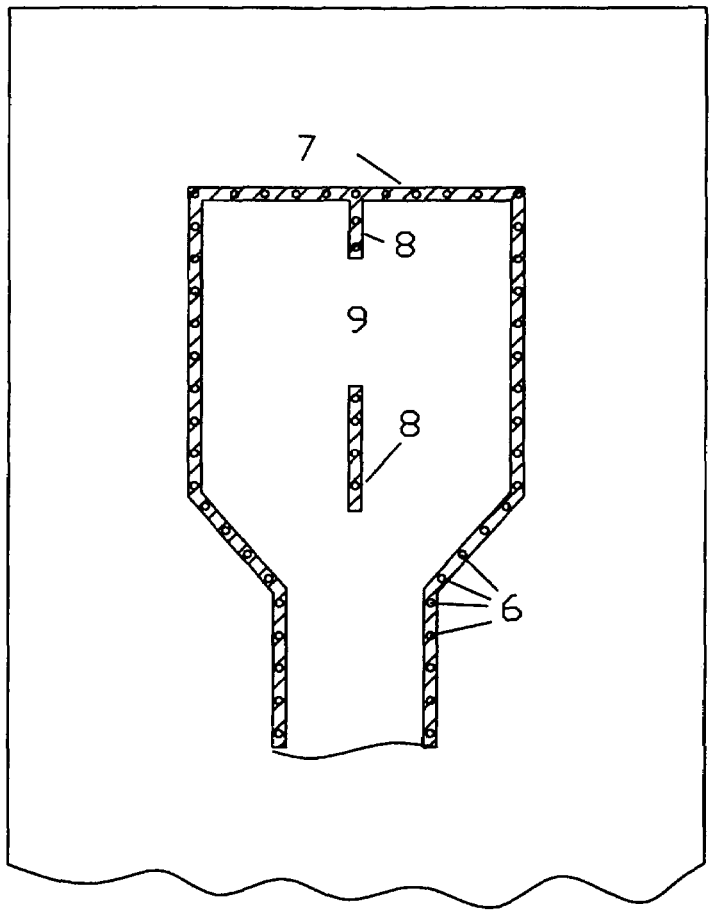
FIG. 5 is a schematic plan view showing circuit pattern of sub-conductor layers in FIG. 1.

FIG. 4 schematically shows the circuit pattern of the sub-conductor layers 2 in FIG. 1, and FIG. 5 schematically shows the circuit pattern of the sub-conductor layers 3 in FIG. 1. Due to the existence of the aperture 9, the circuit pattern on sub-conductor layers 3 is different from that of sub-conductor layers 2 in FIG. 1 of the first embodiment. As shown in FIG. 5, the metal strips of partition wall 8 on a plurality of sub-conductor layers 3 became two segments separated by a non-metal space to form said matching aperture 9.

Figure 6:
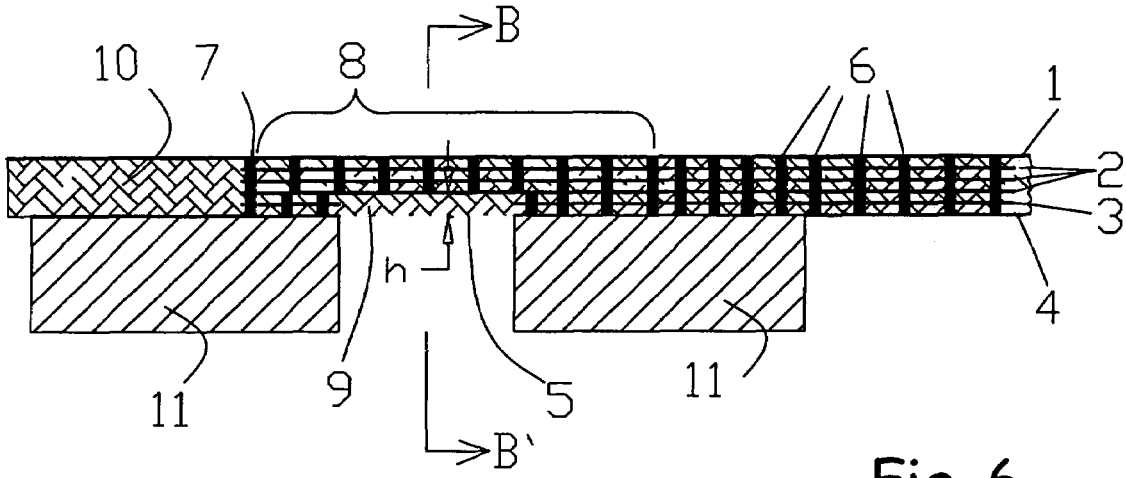
FIG. 6 is a schematic section view of the first embodiment of the invention along the line A–A' in FIG. 1.

FIG. 6 schematically illustrates the section view of the first embodiment of the invention thereof along the line A–A' in FIG. 1. The height of aperture 9 in FIG. 6 is denoted as h, and can be adjusted by controlling the amount of layers of sub-conductor layer 3 as shown in FIG. 6.

Figure 7:
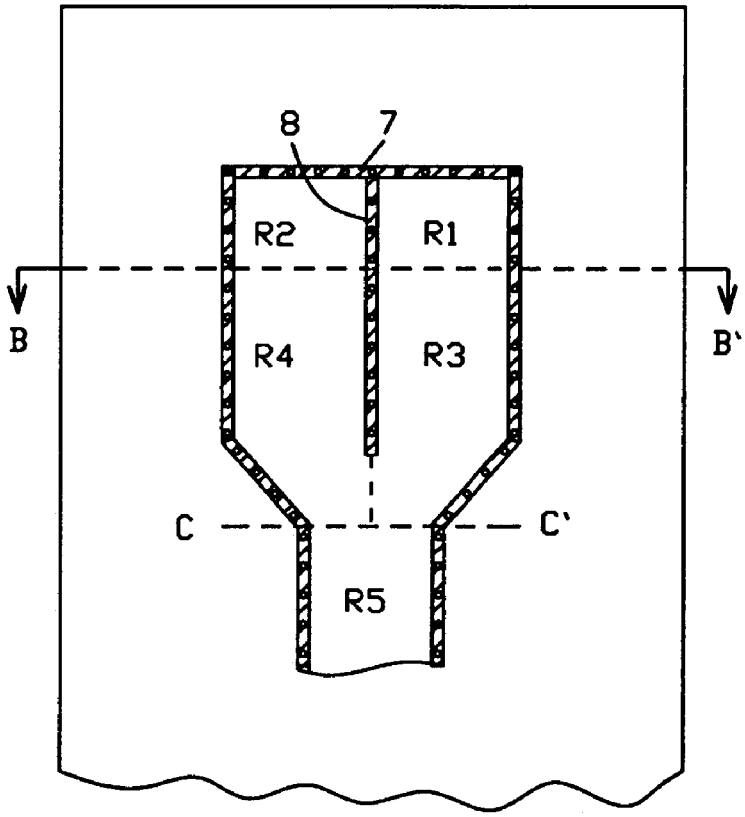
FIG. 7 is a schematic version of FIG. 4 with labels and markings to illustrate equivalent resonators within the first embodiment presented in FIG. 1.

Shielded by the pair of main conductor layers and through the conductive wall, 4 quasi-resonators composing two resonator chains are formed inside the layered dielectric substrate. FIG. 7 schematically illustrates the boundary and name to the four equivalent resonators in the transition of the first embodiments of the invention. From line B–B' to shorting wall 7 in FIG. 7, a pair of type I resonators denoted as R1 and R2 are constructed. The other pair of resonators denoted as R3 and R4 are formed by the laminated waveguide section between B–B' and C–C' shown in FIG. 7. R3 and R4 are type II resonators. RI and R3 form one resonator chain, and R2 and R4 form another resonator chain. The two resonator chains are separated by the partition wall 8 and are coupled with each other via the aperture 9 and the Y junction connecting to the main laminated waveguide R5.

Figure 8:
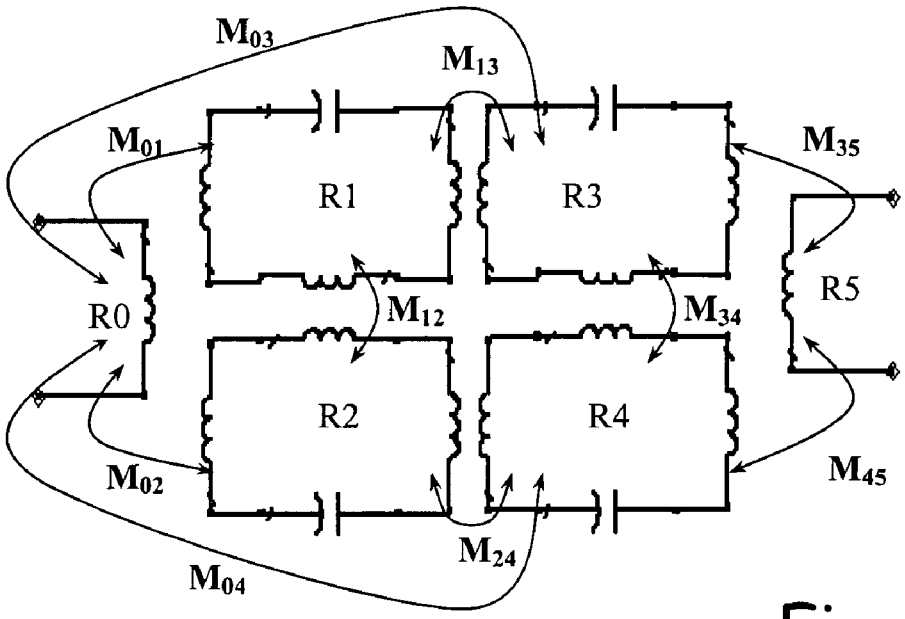
FIG. 8 is an equivalent circuit topology to the transition according to the first embodiment presented in FIG. 1.

Resonator loops R1~R4 in FIG. 8 represent the resonators defined in FIG. 7. R0 and R5 denote the metal waveguide and laminated waveguide region, respectively. The coupling coefficients $M_{0l}$, $M_{02}$, $M_{03}$ and $M_{04}$ denote the coupling between the four resonators and the metal waveguide via aperture 5. The function of the Y branch laminated waveguide power divider is represented as coupling coefficients $M_{35}$ and $M_{45}$ The mutual coupling coefficients $M_{12}$ and $M_{34}$ denote the effects of the matching aperture 9 and the Y junction. The last two coupling coefficients $M_{13}$ and $M_{24}$ represent the connection between two types of resonators.

By adjusting the coupling coefficients between resonators, an expected reflection and transmission performance can be obtained. The coupling coefficients can be controlled by the position of the shorting wall 7, height of aperture 9 and the dimension of the Y branch laminated waveguide power divider. According to the equivalent circuit, the filter coupling matrix module can be employed to synthesize the required performance of the transition of an embodiment of the present invention.

Known from the equivalent circuit shown in FIG. 8, the divider structure is employed to provide a function of creating an in-phase equal amplitude and low insertion loss coupling. Therefore, any kind of H plan waveguide branch or divider structure can be employed in an embodiment of the present invention.

Figure 9:
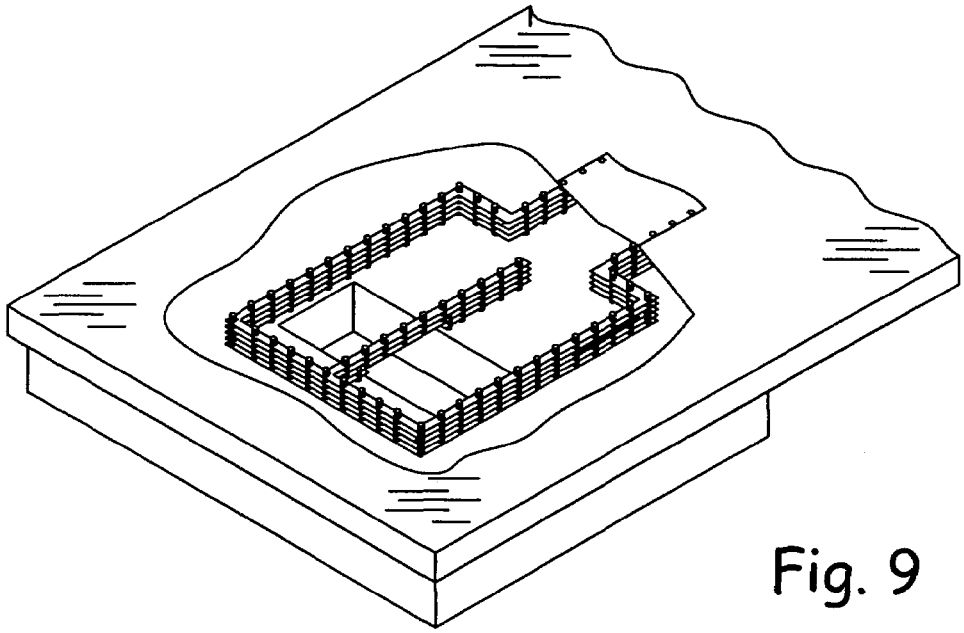
FIG. 9 is a schematic 3D perspective cut-away view of a second embodiment of the present invention.

FIG. 9 schematically shows a second embodiment of the invention, which is an example of using a T type divider structure instead of a Y branch structure.

Figure 10:
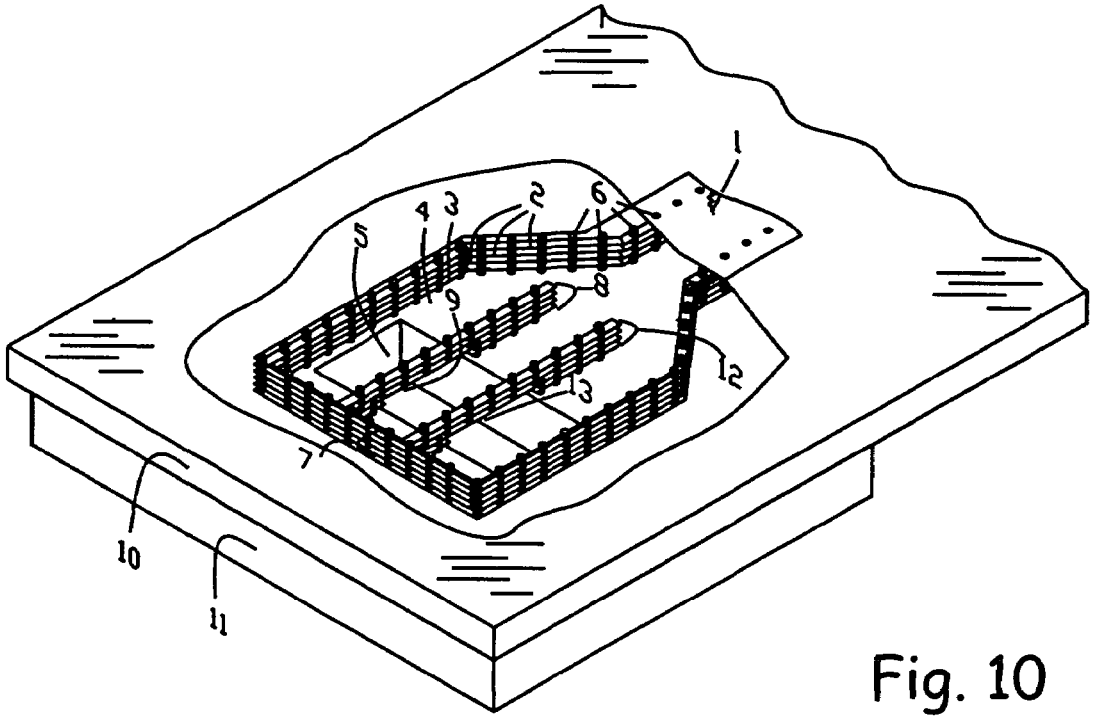
FIG. 10 is a schematic 3D perspective cut-away view of a third embodiment of the present invention.

For some high permittivity applications, the broadside size of the laminated waveguide might be much smaller than half of the broadside size of the metal waveguide. A multi-parallel inter-coupled resonator chain structure can be employed by an embodiment of the present invention FIG. 10 is a schematic perspective cut-away view showing a third embodiment of the transition of the invention. Features in FIG. 10 are numbered from 1–13. Thus, the numbers 1–11, which were used in earlier drawings, are being reused for convenience, because they refer to elements of FIG. 10 that are similar to elements from previous drawings. However, the elements of FIG. 10 are not meant to be identical to elements from earlier drawings, as is apparent from a visual comparison of the drawings.

In FIG. 10, a triple parallel inter-coupled resonator chain structure is presented in the third embodiment of the invention. Separated by two conductive partition walls 8 and 12, three resonator chains are formed inside the transition shown in FIG. 10. The broadside size of the laminated waveguides in FIG. 10 is approximately one third of the metal waveguide broadside size. A three-branch Y type power divider is used as the junction between the main laminated waveguide and three side-by-side laminated waveguide sections in the embodiment. The coupling between adjacent resonator chains is produced by matching aperture 9 and 13 on the two partition walls and the Y junction.

Known from the equivalent circuit, the dimension of the aperture on the lower main conductive layer also can be adjusted to achieve appropriate coupling coefficients.

One transition explained in the first embodiment shown in FIG. 1 was fabricated. The designed center frequency of the transition of an embodiment of the present invention was 29 GHz. The transversal dimensions of the extended waveguide and laminated waveguide are 280 by 140 mils$^2$ and 140 by 35.2 mils$^2$, respectively. Low temperature co-fire ceramics (LTCC) substrate whose relative permittivity $\epsilon_r$=7.5, dielectric loss tan $\sigma$=0.002, and thickness=4.4 mils was used as the dielectric materials of layers and silver alloy was used for metallization. Eight dielectric layers and nine conductive layers were used. The matching aperture dimensions are 140 mils in length and 13.2 mils in height h.

Figure 11:
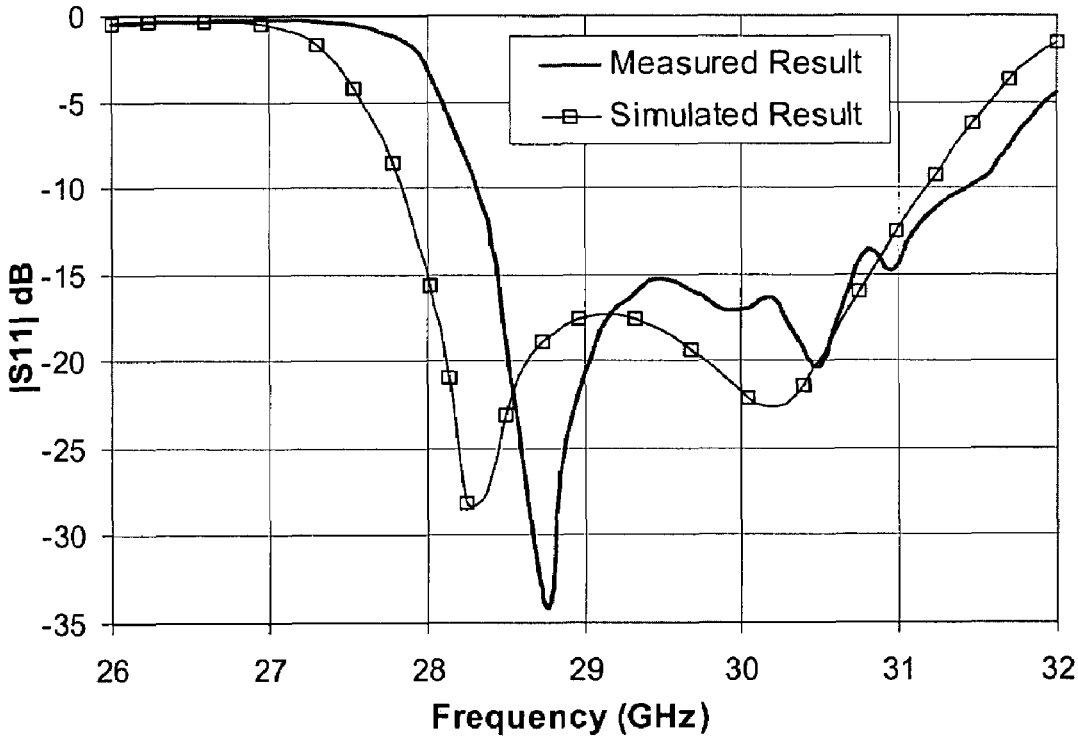
FIG. 11 is a graph that shows simulated and measured reflection performance of an implementation of the embodiment presented in FIG. 1.

FIG. 11 shows the simulated and the measured results of the fabricated prototype of a particular implementation of the first embodiment of the invention. The horizontal axial represents a frequency (GHz), the vertical axis represents an amount of reflection (dB). Defined at −15 dB reflection, the measured bandwidth of the transition is above 2.5 GHz (8.6% with respect to the center frequency 29 GHz). Obtained from measured result to a fabricated back-to-back configuration of the transition pair, the insertion loss of the single transition is lower than 0.45 dB over the whole 2.5 GHz bandwidth with a section of 120 mils laminated waveguide and a 150 mils thick metal waveguide flange.

A designer who wishes to design a particular implementation of an embodiment of the present invention would select the various dimensions and parameters of the embodiment of the present invention in order to obtain desired characteristics. According to conventional design practice, conventional electromagnetic simulation software can be used to select the various dimensions and parameters. For example, a conventional full-wave finite-element method 3-dimensional electromagnetic simulator, may be used. Examples of embodiments of the present invention, as well as the use of simulation to select dimensions and parameters, are discussed in an article by the present inventors, Yong Huang and Ke-Li Wu, "A Broad-Band LTCC Integrated Transition of Laminated Waveguide to Air-Filled Waveguide for Millimeter-Wave Applications", in IEEE Transactions on Microwave Theory and Techniques, Vol. 51, No. 5, May 2003, which is hereby incorporated by reference in its entirety for all purposes.

Figure 12:
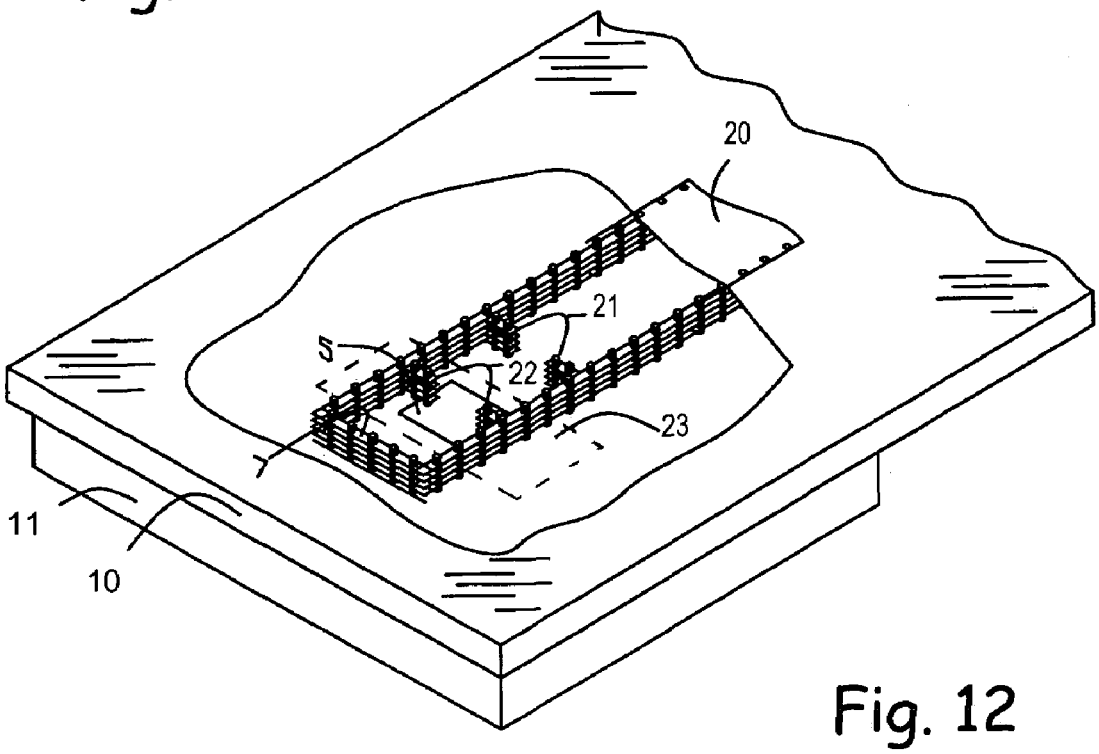
FIG. 12 is a schematic 3D perspective cut-away view of a fourth embodiment of the present invention.

FIG. 12 is a schematic 3D perspective cut-away view of a fourth embodiment of the present invention. A single laminated waveguide resonator chain structure that contains more than one resonator is presented in FIG. 12. For example, one resonator in the resonator chain is constructed of a perturbing conducting wall 22 and a shorting conducting wall 7; the other resonator in the chain is formed by a perturbing conducting wall 21 and the perturbing conducting wall 22. The laminated waveguide and the resonator chain are constructed by grid like conducting walls on two sides and the top and bottom surfaces of the substrate, except the coupling aperture 5 on the bottom surface. Coupling aperture 5 is smaller than the aperture of metal waveguide 23, shown in dashed lines. The perturbing conducting walls 21 and 22 are introduced to control the couplings between laminated waveguide 20 and resonators, respectively. The size of coupling aperture 5 controls the coupling between the metal waveguide and the resonators in the substrate.

Specific example embodiments of the present invention are discussed below.

EXAMPLE EMBODIMENT 1

A waveguide to laminated waveguide transition comprising:

a dielectric substrate;

a pair of main conductive layers deposited on the upper dielectric layer surface and the lower dielectric layer surface of the dielectric substrate and said upper main conductive layer and lower conductive layer;

a plurality of conductor walls comprising:

a plurality of through conductors, such as via-holes, extending in a thickness direction in the dielectric substrate layers; and a number of optional sub-conductor layers paralleled to the two main conductive layers and deposited between the dielectric layer of a dielectric substrate so that they are electrically connected to the through conductors to form the conductive walls;

a plurality of laminated waveguide comprising:

the upper and the lower main conductor layers working as broadside walls; and two conductor walls as sidewalls that electrically connect the upper and the lower main conductor layers to form a waveguide structure inside the dielectric substrate;

an aperture laying on one of the said main conductive layers so that the energy is transferred between the region inside the dielectric substrate and the outside via the aperture;

a multi-parallel inter-coupled resonator chain structure comprising:

a transition region over the aperture covered by the two main conductive layers, encircled by the conductive walls and terminated by a section of laminated waveguide;

at least one conductive wall called a partition wall separating the region into at least two parts of sub laminated waveguides;

at least one segment of the conductor wall shorted at one end of the sub laminated waveguide, which is said shorting wall, and the other end of the sub laminated waveguide terminated by a multi-branch junction; here, the shorting wall to each sub laminated waveguide can be disposed on different plane;

a multi-branch structure connecting with the other end of the sub laminated waveguide and distributing the energy from the laminated waveguide to the sub laminated waveguides or combining the energy from the sub laminated waveguides to the laminated waveguide;

at least one aperture called the matching aperture located on each partition wall to adjust the matching condition looking from the metal waveguide side; and a waveguide extension having a conductive tube carrying the RF energy.

EXAMPLE EMBODIMENT 2

The waveguide to laminated waveguide transition of example embodiment 1, wherein the waveguide extension comprises a waveguide flange soldered on the system ground and aligned with said aperture, or a plurality of plated or conductor filled through via-holes, or a waveguide formed by an aperture in a base of conducting material.

EXAMPLE EMBODIMENT 3

The waveguide to laminated waveguide transition of example embodiment 2, wherein said dielectric layers comprise low temperature co-fired ceramics (LTCC).

EXAMPLE EMBODIMENT 4

The waveguide extension of example embodiment 1 having cross section of either rectangular shape supporting TE 10 mode as dominant mode or circular shape supporting TE 11 mode as dominant mode.

EXAMPLE EMBODIMENT 5

The performance of the circuit module of example embodiment 1 can be adjusted by the aperture on the main conductive layer, the matching aperture, the distance from the shorting wall to the center of the aperture and the multi-branch junction.

EXAMPLE EMBODIMENT 6

A transition circuit module comprising:

a dielectric substrate;

a pair of main conductive layers deposited on the upper dielectric layer surface and the lower dielectric layer surface of the dielectric substrate and the upper main conductive layer and the lower conductive layer;

a plurality of conductor walls comprising:

a plurality of through conductors, such as via-holes, extending in a thickness direction in the dielectric substrate layers; and a number of optional sub-conductor layers paralleled to the two main conductive layers and deposited between the dielectric layer of a dielectric substrate so that they are electrically connected to the through conductors to form the conductive walls;

a plurality of laminated waveguides comprising:

the upper and the lower main conductor layers working as broadside walls; and two conductor walls as sidewalls so that electrically connecting the upper and the lower main conductor layers form a waveguide structure inside the dielectric substrate;

an aperture laying on one of the main conductive layers so that the energy is transferred between the region inside the dielectric substrate and the outside via the aperture;

a multi-parallel inter-coupled resonator chain structure comprising:

a transition region over the aperture covered by the two main conductive layers, encircled by the conductive walls and terminated by a section of the laminated waveguide;

at least one conductive wall called a partition wall separating the region into at least two parts of sub laminated waveguides;

at least one segment of the conductor wall shorted at one end of the sub laminated waveguide, which is the shorting wall, and the other end of the sub laminated waveguide terminated by a multi-branch junction; here, the shorting wall to each sub laminated waveguide can be disposed on a different plane;

a multi-branch structure connecting with the other end of the the sub laminated waveguide and distributing the energy from the laminated waveguide to the sub laminated waveguides or combining the energy from the sub laminated waveguides to the laminated waveguide;

at least one aperture called the matching aperture located on each partition wall to produce inter coupling between adjacent parts; and a metal base supporting the dielectric substrate, the metal base having an aperture aligned with the the aperture on the the main conductive layer.

EXAMPLE EMBODIMENT 7

The circuit module of example embodiment 6, wherein the metal base, the lower main conductive layer and the dielectric substrate, comprise a hermetically sealed package.

EXAMPLE EMBODIMENT 8

The circuit module of example embodiment 6, further comprising at least one additional transition from the laminated waveguide to another form of transmission line, e.g., a microstrip line or stripline, e.g., underneath aperture 9 of FIG. 1

EXAMPLE EMBODIMENT 9

The circuit module of example embodiment 8, further comprising at least one processing circuit connected to the microstrip line or the stripline.

EXAMPLE EMBODIMENT 10

The circuit module of example embodiment 9, further comprising a heat sink located in proximity to at least one processing circuit.

EXAMPLE EMBODIMENT 11

The circuit module of example embodiment 10, wherein the heat sink comprising a plurality of via-holes connecting the ground plane under the the processing circuit and the lower main conductive layer, to which the metal base is soldered.

EXAMPLE EMBODIMENT 12

The transition circuit module of example embodiment 6 is a part of an integrated antenna module.

EXAMPLE EMBODIMENT 13

The transition circuit module of example embodiment 6 is a part of an integrated module comprising an MMIC.

EXAMPLE EMBODIMENT 14

The transition circuit module of example embodiment 6 is used in a module incorporating laminated waveguide filters and a diplexer.

EXAMPLE EMBODIMENT 15

The waveguide extension of example embodiment 6 has a cross section of either rectangular shape supporting TE10 mode as the dominant mode or circular shape supporting TE 11 mode as the dominant mode.

EXAMPLE EMBODIMENT 16

The performance of the circuit module of example embodiment 6 can be adjusted by the aperture on the main conductive layer, the matching aperture, and the distance from the short-wall to the center of the aperture and the multi-branch junction.

Throughout the description and drawings, example embodiments are given with reference to specific configurations. It will be appreciated by those of ordinary skill in the present art that the present invention can be embodied in other specific forms without departing from the spirit and scope of the present invention. Changes and modifications are to be understood as included within the scope of the present invention. The scope of the invention is not limited merely to the specific example embodiments of the foregoing description but rather is indicated by the appended claims.

The invention claimed is:

1. An apparatus through at least a portion of which electromagnetic waves are to be propagated, comprising:

a boundary structure, that defines at least a transition interior, said boundary structure comprising electrically-conductive materials, said boundary structure further defining a first opening and a second opening to said transition interior, said first opening configured to be open toward a first interior, of a first waveguide, said first waveguide being laminated on a substrate, and said second opening configured to be open toward a second interior, of a second waveguide, said second interior being defined by an electrically-conductive structure of said second waveguide, whereby an electromagnetic wave is capable of being propagated, in operation, via said transition interior, from one of said first interior and said second interior to the other of said first interior and said second interior, wherein said first interior has a dielectric constant that differs from a dielectric constant of content of said second interior, and said second waveguide is not laminated on the substrate on which the first waveguide is laminated, wherein said boundary structure along with said transition interior, is modeled by an equivalent circuit that includes at least two cascaded resonators.

2. An apparatus as described in claim 1, wherein said second waveguide is a metal waveguide, and said electrically-conductive structure of said second waveguide comprises solid metal walls.

3. An apparatus as described in claim 1, wherein said transition interior and said first interior comprise solid dielectric material, and said second interior comprises one of air and solid or partially solid dielectric material.

4. An apparatus as described in claim 3, wherein said second interior comprises air.

5. An apparatus as described in claim 3, wherein said solid dielectric material of said first interior comprises low-temperature co-fired ceramics (LTCC).

6. An apparatus as described in claim 1, wherein said first waveguide and said second waveguide are configured for propagating electromagnetic waves of at least 10 GHz.

7. A method for transitioning electromagnetic waves from the first waveguide to the second waveguide, within the apparatus described in claim 1, the method comprising:

accepting an electromagnetic wave, from said one of said first interior and said second interior, into said transition interior; and conveying said electromagnetic wave from said transition interior into said other of said first interior and said second interior.

8. An apparatus as described in claim 1, wherein said boundary structure is configured, together with said transition interior, to include at least two mutually-parallel intercoupled resonator chains, each of said resonator chains being modeled by an equivalent circuit that includes at least two cascaded resonators.

9. An apparatus as described in claim 1, wherein said boundary structure is configured to provide a return loss profile that includes at least two reflection zeroes.

10. An apparatus as described in claim 1, wherein said boundary structure is configured to provide a bandwidth of at least 2.5 GHz, with a return loss below −15 dB within said bandwidth, for transitioning an electromagnetic wave of at least 10 GHz from said one of said first interior and said second interior to the other of said first interior and said second interior.

11. An apparatus as described in claim 1, wherein said second opening has a same shape and size as a cross section of said second waveguide.

12. An apparatus as described in claim 1, wherein said boundary structure, when considered in a particular orientation, comprises an upper electrically-conductive layer and a lower electrically-conductive layer connected by one or more electrically-conductive walls.

13. An apparatus as described in claim 12, wherein said electrically-conductive walls are not continuous sheets of electrically-conductive material but instead, when considered from said particular orientation, each comprises horizontal layers of electrically-conductive material, said horizontal layers having dielectric materials between them, said horizontal layers being connected inter-layer by via-holes filled with electrically-conductive material.

14. An apparatus as described in claim 12, wherein, when considered from said particular orientation, said second opening is an opening in one of said electrically-conductive layers, said second opening being enclosed, in a floor-plan view in said particular orientation, by said electrically-conductive walls and by said first opening.

15. An apparatus as described in claim 13, wherein, when considered from said particular orientation, said second opening is an opening in said lower electrically-conductive layer, said second opening being enclosed, in a floor-plan view in said particular orientation, by said electrically-conductive walls and by said first opening.

16. An apparatus as described in claim 15, further comprising at least an electrically-conductive wall, hereinafter referred to as partition wall, that helps define two inter-coupled resonator chains.

17. An apparatus as described in claim 16, wherein, when considered from said particular orientation, said partition wall overlies said second opening.

18. An apparatus as described in claim 17, wherein, when considered from said particular orientation, said partition wall defines a cut-out at a bottom thereof, over said second opening, that provides an improved matching condition to the second waveguide.

19. An apparatus as described in claim 1, wherein said dielectric constants differ from one another by a value of at least three.

20. An apparatus as described in claim 1, wherein said second waveguide has a cross section of either a rectangular shape or a circular shape.

21. An apparatus as described in claim 1, further comprising packaging, wherein said apparatus is hermetically sealed.

22. An apparatus as described in claim 1, wherein said boundary structure is integrally fabricated on the same substrate as said first waveguide.

23. An apparatus as described in claim 22, further comprising a transition from said first waveguide to a transmission line, other than said second waveguide, said transmission line not being a metal waveguide that defines an interior and not being a laminated waveguide.

24. An apparatus as described in claim 23, further comprising a diplexer coupled to said first waveguide.

25. An apparatus as described in claim 23, wherein said transmission line is a microstrip line or a stripline, said apparatus further comprising at least one processing circuit connected to said microstrip line or said stripline.

26. An apparatus as described in claim 25, further comprising a monolithic microwave integrated circuit (MMIC), coupled to said microstrip line or said stripline.

27. A method for producing a waveguide-to-waveguide transition, the method comprising:

fabricating transition boundary structure, said transition boundary structure defining a transition interior, including a first opening and a second opening to said transition interior, wherein, at least after said transition is deployed in operation, said first opening is to open toward a first interior of a first waveguide and said second opening is to open toward a second interior of a second waveguide, said first and second interiors comprising mutually-different dielectric materials having mutually-different finite dielectric constants, wherein said transistion boundary structure along with said transition interior, is modeled by an equivalent circuit that includes at least two cascaded resonators.

28. A method as described in claim 27, further comprising joining said electrically-conductive structure with an electrically-conductive structure of said first waveguide whereby said first opening opens to said first interior.

29. A method as described in claim 27, wherein said fabricating step comprises:

fabricating a first layer that includes an electrically-conductive material;

fabricating a second layer that includes an electrically-conductive material; and fabricating walls that include an electrically-conductive material, said walls joining said first and second layers, said transition boundary structure comprising said first and second layers and said walls.

30. A method as described in claim 29, wherein said step of the fabricating said walls comprises laminating multiple layers of electrically-conductive material, there being dielectric material between portions of said multiple layers of electrically-conductive material, said multiple layers of electrically-conductive material joined by via holes filled with electrically-conductive material, wherein electromagnetic waves to be handled by said transition would be prevented from escaping through said walls.

31. A method as described in claim 30, wherein said first waveguide is laminated on a substrate, and wherein said step of fabricating said transition boundary structure comprises fabricating said transition boundary structure on the same substrate as said first waveguide.

32. A method as described in claim 27, wherein said first waveguide is a laminated waveguide, and said second waveguide is a metal waveguide.

33. A method for transitioning electromagnetic waves from a first waveguide to a second waveguide, said first waveguide having a first interior defined by an electrically-conductive first structure, said second waveguide having a second interior defined by an electrically-conductive second structure, wherein said interiors include respective dielectric material having mutually-different finite dielectric constants, the method comprising:

accepting an electromagnetic wave directly from said first interior into a transition interior, of a transition, said transition interior being defined by an electrically-conductive structure of said transition, said transition interior being open to said first and second interiors; and conveying said electromagnetic wave from said transition interior directly into said second interior, wherein a boundary structure along with said transition interior, is modeled by an equivalent circuit that includes at least two cascaded resonators.

34. A method as described in claim 33, wherein said conveying step comprises degrading signal quality of said electromagnetic wave according to a reflection loss profile of said transition, wherein said reflection loss profile includes at least two reflection zeroes.

35. A method as described in claim 34, wherein said electromagnetic wave is of at least 10 GHz, and said reflection loss profile provides a bandwidth of at least 2.5 GHz over which return loss is below −15 dB for said electromagnetic wave.

36. A method as described in claim 33, wherein said electromagnetic wave is of at least 10 GHz.

37. A method as described in claim 33, wherein said transition is configured for said transition interior to include a portion having at least two branches, at least a first branch of said two branches capable of being modeled by a model that includes at least two cascaded resonators.

* * * * *